US009233035B2

(12) United States Patent
Baverso

(10) Patent No.: US 9,233,035 B2
(45) Date of Patent: Jan. 12, 2016

(54) SUPPORT CHAIR FOR BODY CAST PATIENTS

(76) Inventor: Paul Baverso, Wilmerding, PA (US)

( * ) Notice: Subject to any disclaimer, the term of this patent is extended or adjusted under 35 U.S.C. 154(b) by 2173 days.

(21) Appl. No.: 11/494,428

(22) Filed: Jul. 27, 2006

(65) Prior Publication Data

US 2007/0024015 A1 Feb. 1, 2007

Related U.S. Application Data

(60) Provisional application No. 60/703,213, filed on Jul. 28, 2005.

(51) Int. Cl.

| | |
|---|---|
| ***A47K 11/06*** | (2006.01) |
| ***A61G 5/10*** | (2006.01) |
| *A61G 5/12* | (2006.01) |

(52) U.S. Cl.

CPC ..... *A61G 5/1002* (2013.01); *A47K 11/06* (2013.01); *A61G 5/10* (2013.01); *A61G 2005/1091* (2013.01); *A61G 2005/1094* (2013.01); *A61G 2005/125* (2013.01)

(58) Field of Classification Search

CPC ..... A61G 5/1002
USPC ..... 4/480; 297/466, 467, 106–108, 344.18
See application file for complete search history.

(56) References Cited

U.S. PATENT DOCUMENTS

| | | | | |
|---|---|---|---|---|
| 1,252,751 | A * | 1/1918 | Weatherford | 297/466 |
| 3,166,354 | A * | 1/1965 | Sorensen | 297/160 |
| 3,992,057 | A * | 11/1976 | Studebaker | 297/467 |
| D247,232 | S | 2/1978 | Gunnell | |
| 4,145,082 | A * | 3/1979 | Daly et al. | 297/466 |
| 4,361,916 | A | 12/1982 | McDaniel | |
| 4,612,676 | A * | 9/1986 | Whitman | 4/300.3 |
| 5,040,522 | A * | 8/1991 | Daniels | 601/24 |
| 5,123,126 | A * | 6/1992 | Vincent | 4/480 |
| 5,203,612 | A * | 4/1993 | Pokrzywinski | 297/466 |
| 5,301,903 | A * | 4/1994 | Aronne | 244/122 AG |
| D362,911 | S | 10/1995 | Helms | |
| 5,647,639 | A | 7/1997 | Wiggins | |
| 5,781,939 | A | 7/1998 | Bledsoe | |
| 6,000,761 | A | 12/1999 | Rocha | |
| 6,056,353 | A * | 5/2000 | Meara | 297/41 |
| 6,203,106 | B1 | 3/2001 | Nearing et al. | |
| 6,390,287 | B2 * | 5/2002 | Riffe | 198/830 |
| 6,418,571 | B1 * | 7/2002 | Cheng | 4/480 |
| 6,450,518 | B1 | 9/2002 | Howard | |
| 6,540,250 | B1 | 4/2003 | Peterson | |
| 6,547,265 | B1 | 4/2003 | Enge et al. | |
| 6,568,762 | B2 * | 5/2003 | Porcheron | 297/466 |
| 6,770,013 | B2 * | 8/2004 | Stillinger | 482/91 |
| 6,923,410 | B2 * | 8/2005 | Chang | 248/188.5 |

* cited by examiner

*Primary Examiner* — Lori Baker
(74) *Attorney, Agent, or Firm* — Alan G. Towner, Esq.; Pietragallo Gordon Alfano Bosick & Raspanti, LLP

(57) ABSTRACT

A support chair for a patient in a body cast, such as a child or toddler wearing a spica cast, is disclosed. The support chair may hold the patient in a generally upright position and the seat may include a cut-out portion positionable over a commode. The chair may include stationary or adjustable leg support stirrups which support a portion of the body cast. The seat, back and/or legs of the support chair may be adjustable in order to change the height or inclination angle of the chair. Optional attachments include removable armrests, bed pan, splash guard and activity tray.

34 Claims, 5 Drawing Sheets

SUPPORT CHAIR FOR BODY CAST PATIENTS

CROSS REFERENCE TO RELATED APPLICATION

This application claims the benefit of U.S. Provisional Patent Application Ser. No. 60/703,213 filed Jul. 28, 2005, which is incorporated herein by reference.

FIELD OF THE INVENTION

The present invention relates to support chairs for patients in full or partial body casts, such as a child or toddler wearing a spica cast. The support chair holds the patient in a generally upright position and may be positionable over a commode or provided with a bedpan or other waste collection device.

BACKGROUND INFORMATION

A body cast or spica cast is used to immobilize the hips and thighs of a patient to assist in the healing of bones, muscles and tendons. Spica casts are typically used on children following surgery or a reduction to hold the hips in a position that facilitates bone growth. The casts may begin at the chest and extend to cover both legs down to the toes or knee, or one leg down to the toes or knee and the other leg down to the hip or knee. A similar type of cast known as an abduction boot extends from the upper thigh of each leg down to the foot.

Spica casts and abduction boots are customized for each patient depending on his or her body type and recovery needs. The casts are made from fiberglass or plaster, and a rigid bar is often placed between the legs to ensure immobility. The casts should be kept as dry as possible so that they do not cause skin irritation or lose their proper shape due to softening and cracking.

Spica casts typically contain an opening between the legs for the patient to use the bathroom. For infants and toddlers, a disposable diaper is tucked into the edges of this opening, a second diaper is placed on top of this diaper, and an additional bladder control diaper is placed on top of the second diaper. A material such as moleskin is often placed around the edges of the cast to help prevent the cast from soiling. The child's head should be elevated above his feet to assist in draining urine and stool away from the cast. The diaper and plastic wrap should be changed immediately after wetting to maintain the cast's integrity. Older children can be rolled onto their sides to use a bed pan or urinal, but soiling of the cast is still a problem. Sponge baths are the only form of bathing for children wearing spica casts. The child is generally restricted to lying in bed, and his or her position must be changed periodically throughout the day and night.

SUMMARY OF THE INVENTION

The present invention provides a support chair for a patient in a body cast, such as a child or toddler wearing a spica cast. Other types of patients include patients suffering from spina bifida, multiple sclerosis, spinal injuries and the like which must be supported in a fully or partially upright position. In one embodiment, the support chair holds the patient in a generally upright position and is positionable over a commode. The chair may include stationary or adjustable leg support stirrups, as well as optional attachments such as a removable bed pan, splash guard, armrests and tray table. The seat, back and/or legs of the chair may also be adjustable to different heights and/or different inclination angles.

An aspect of the present invention is to provide a support chair for a patient comprising a seat, and at least one stirrup disposed on the seat structured and arranged to support a body cast of the patient and/or a leg of the patient.

Another aspect of the present invention is to provide a support chair for a patient comprising a seat structured and arranged to support the body cast of a patient and/or a leg of the patient, and an opening in the seat to allow the patient to use a waste collection device.

A further aspect of the present invention is to provide a seat for a patient comprising at least one stirrup disposed on the seat structured and arranged to support a body cast of the patient and/or a leg of the patient, and an opening in the seat to allow the patient to use a waste collection device.

These and other aspects of the present invention will be more apparent from the following description.

DETAILED DESCRIPTION

Figure 1:
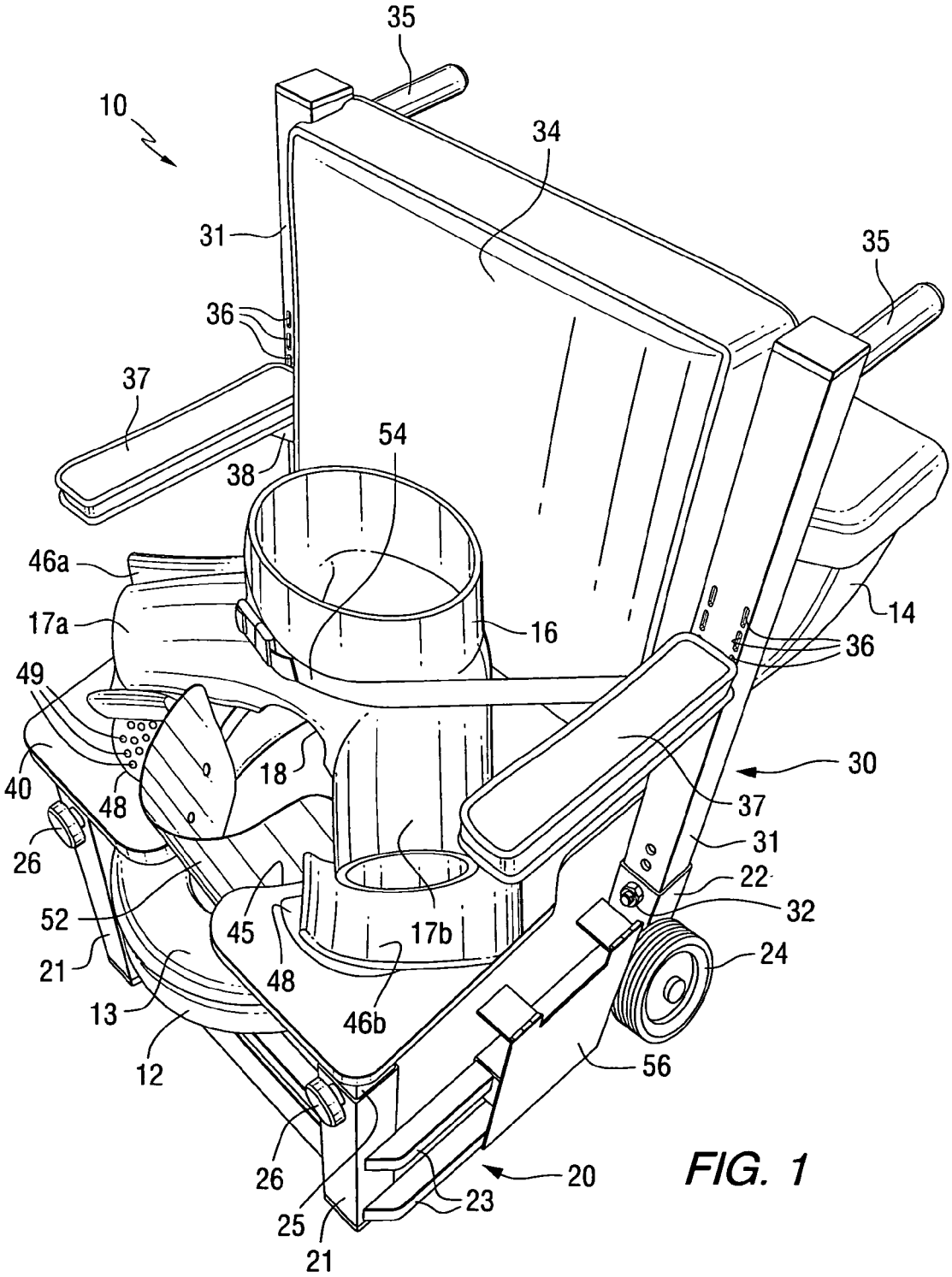
FIG. 1 is an isometric view of a support chair in accordance with an embodiment of the present invention.

FIG. 1 illustrates a support chair 10 in accordance with an embodiment of the present invention. The support chair 10 is positioned over a toilet 12 having a toilet seat 13 and a toilet tank 14. A portion of a body cast 16 is shown resting on the support chair 10. The body cast 16 has legs 17*a* and 17*b*, and an opening 18 in the crotch. The body cast 16 may be a spica cast or the like.

As shown in FIGS. 1-5, the support chair 10 has a base 20, back 30 and seat 40. The base 20 includes front legs 21, rear legs 22 and horizontal supports 23 connecting the front and rear legs. In the embodiment shown, wheels 24 are mounted at the bottoms of the rear legs 22. Front extension arms 25 are slidably mounted in the front legs 21. Height adjusting knobs 26 are used to secure the front extension arms 25 at desired heights. As shown most clearly in FIG. 2, a spring 27 inside each front leg 21 contacts the bottom 28 of each front extension arm 25 to bias the arm 25 upward in order to facilitate height adjustment of the seat 40.

Figure 2:
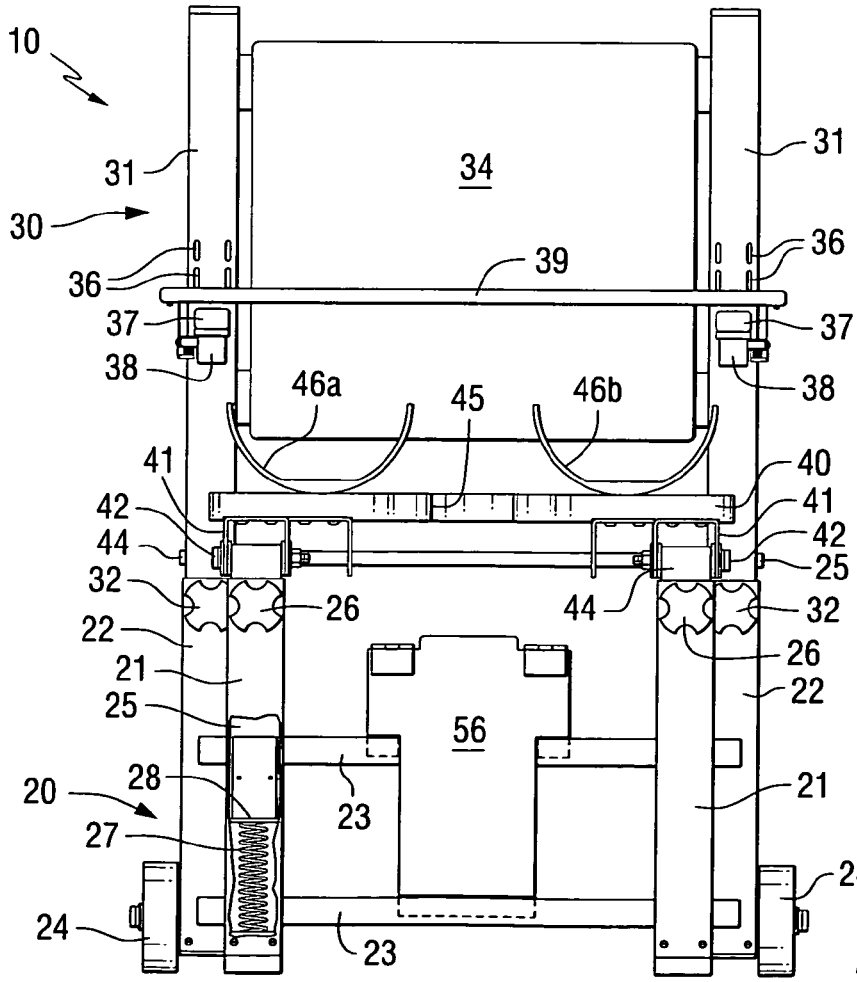
FIG. 2 is a front view of a support chair in accordance with an embodiment of the present invention.

The back 30 of the support chair 10 includes rear extension arms 31 slidably received in the rear legs 22. Height adjusting knobs 32 are used to secure the extension arms 31 at their desired heights. Although not shown in the figures, biasing springs similar to the spring 27 shown in FIG. 2 are also installed in the rear legs 22 to bias the rear extension arms 31 upward. As most clearly shown in FIG. 5, horizontal supports 33 are connected between the rear extension arms 31. The back 30 includes a cushioned backrest 34. Handles 35 may optionally be mounted on the rear extension arms 31 in order to facilitate movement of the support chair 10 to desired locations. Armrest height adjustment slots 36 are provided in the rear extension arms 31. Armrests 37 secured to brackets 38 are removably attached to the rear extension arms 31 in the slots 36 at adjustable heights. As shown most clearly in FIGS. 2-4, an activity tray assembly 39 may be removably mounted on or above the armrests 37. The tray 39 may be extended and retracted horizontally away from or toward the rear extension arms 31.

The support chair seat 40 is pivotally mounted on the front extension arms 25 with front mounting brackets 41 and front mounting pins 42. Back mounting brackets 43 secured to the seat 40 include slots into which a back mounting pin 44 is inserted to pivotally mount the seat 40 to the back extension arms 31. The front mounting brackets 41 and pins 42, and the slotted back mounting brackets 43 and pin 44, allow the seat 40 to be tilted forward or backward at selected angles and at selected heights. The seat may be tilted forward or backward to different inclination angles such as ±30° or more measured from horizontal. For example, the seat may be tilted forward in order to accommodate a spica cast or other patient to an inclination angle of from 5 to 30 degrees. Furthermore, the back 30 may be pivoted or reclined to any desired angle in order to accommodate a particular patient. For example, the rear extension arms 31 may be pivoted backward using any conventional reclining mechanism (not shown) to a selected angle of up to 90° from vertical.

The support chair seat 40 has a cutout 45 which allows a patient to use a toilet, bedpan or other waste collection device. For example, as shown in FIG. 1, the cutout 45 of the seat 40 may have a similar shape and be positioned over a toilet seat opening 13. Alternatively, a bedpan or other collection device may be supported below the cutout 45.

As the patient uses the toilet 12, his or her legs are comfortably supported in the stirrups 46*a* and 46*b* on either side of the cut-out 45, and the seat 40 and back 34 provide additional support. The cut-out may have any suitable size and shape, such as a U-shape, circle, oval, square or the like. In the embodiment shown in the figures, the cut-out 45 is provided as a generally U-shaped opening at the front of the chair seat 40. Alternatively, the cut-out may be closed at the front of the seat 40. The cut-out 45 may also be fitted with a removable plate (not shown) to close off the opening when not in use.

In accordance with an embodiment of the present invention, stirrups 46*a* and 46*b* are mounted on the seat 40. As shown in FIG. 1, the stirrups 46*a* and 46*b* may be positioned to support the leg portions 17*a* and 17*b* of a body cast 16. The seat 40 includes mounting plates 48 with multiple alignment holes 49.

Figure 6:
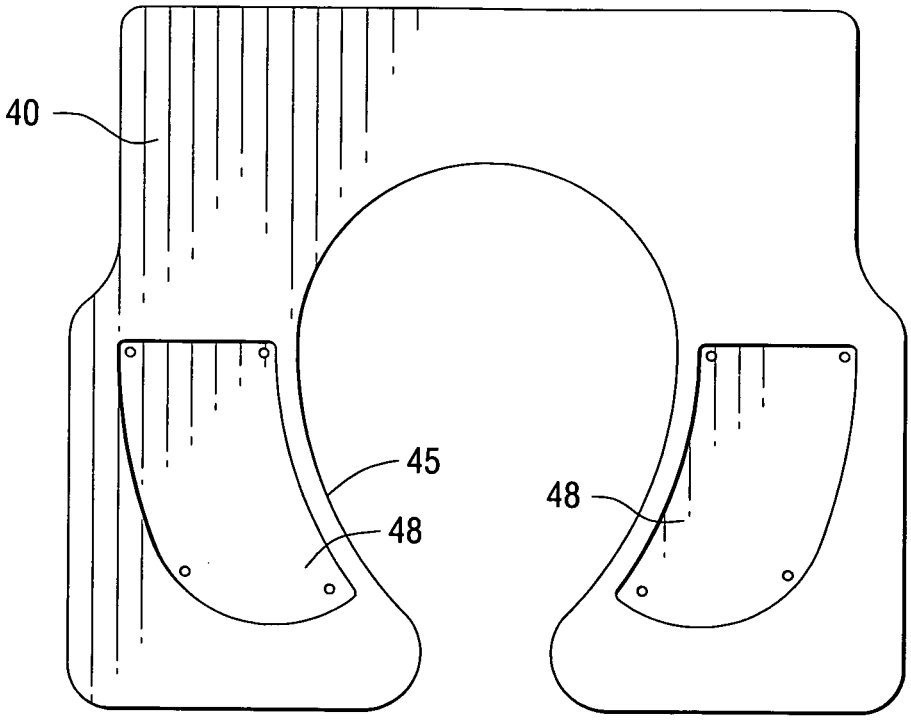
FIG. 6 is a top view showing details of a seat of the support chair in accordance with an embodiment of the present invention.
Figure 7:
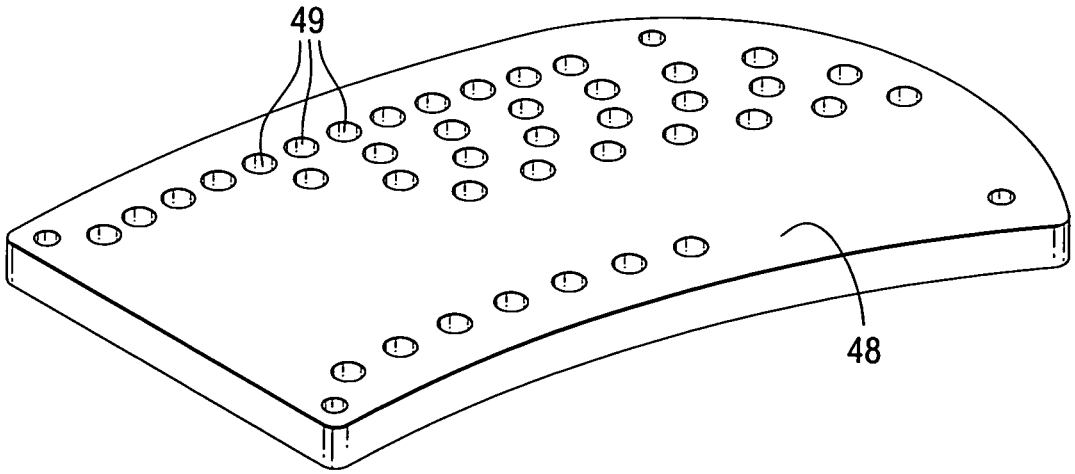
FIG. 7 is an isometric view showing details of a stirrup support plate which may be mounted on the seat of a support chair in accordance with an embodiment of the present invention.

FIGS. 6 and 7 illustrate details of the mounting plates 48 which may be used to adjust the positions of the stirrups 46*a* and 46*b*. As shown in FIG. 6, the mounting plates 48 are positioned near the cutout 45 of the seat 40 and extend from the middle toward the front of the seat 40. As shown in FIG. 7, each plate 48 includes multiple holes 49 which serve to align and fasten the stirrup in the desired orientation on the seat 40. Thus, the stirrups 46*a* and 46*b* may be adjustably mounted on the seat, e.g., at different locations along the width of the seat, at different locations along the depth of the seat (measured from the front to the back of the seat), and at different angular orientations on the seat.

Figure 9:
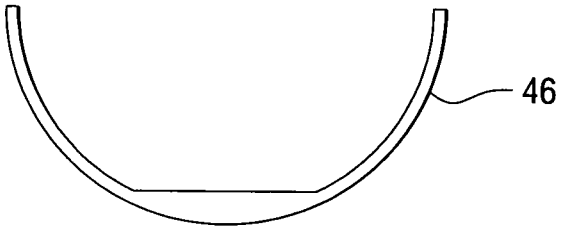
FIG. 9 is an end view of the stirrup of FIG. 8.
Figure 8:
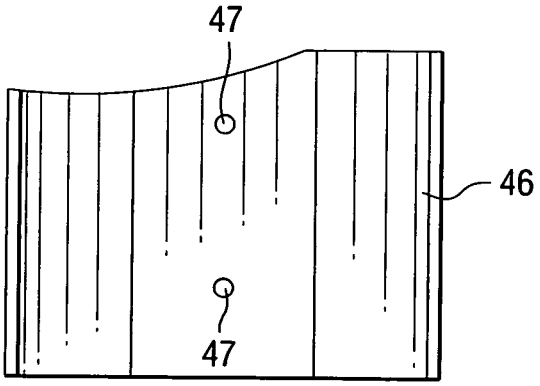
FIG. 8 is a top view of a stirrup that may be mounted on a support chair in accordance with an embodiment of the present invention.

FIGS. 8 and 9 are top and end views of a stirrup 46 in accordance with an embodiment of the present invention. As shown in FIG. 8, the stirrup 46 has two mounting holes 47 which receive a flush-mounted bolt or other type of mechanical fastener (not shown) which may be fastened in a selected alignment hole 49 on the mounting plate 48. As shown in FIG. 9, the stirrup 46 has a generally hemispherical cross section shaped to receive a cast or leg of a patient. Any other suitable stirrup shape and/or size may be used such as deep or shallow U shapes, V shapes and rectangular shapes. The stirrups may be provided in various sizes to accommodate different types of casts and different sizes of patients. In one embodiment, the stirrup 46 may be covered with any suitable type of material such as a fabric, cushion, non-slip material, and the like.

Figure 3:
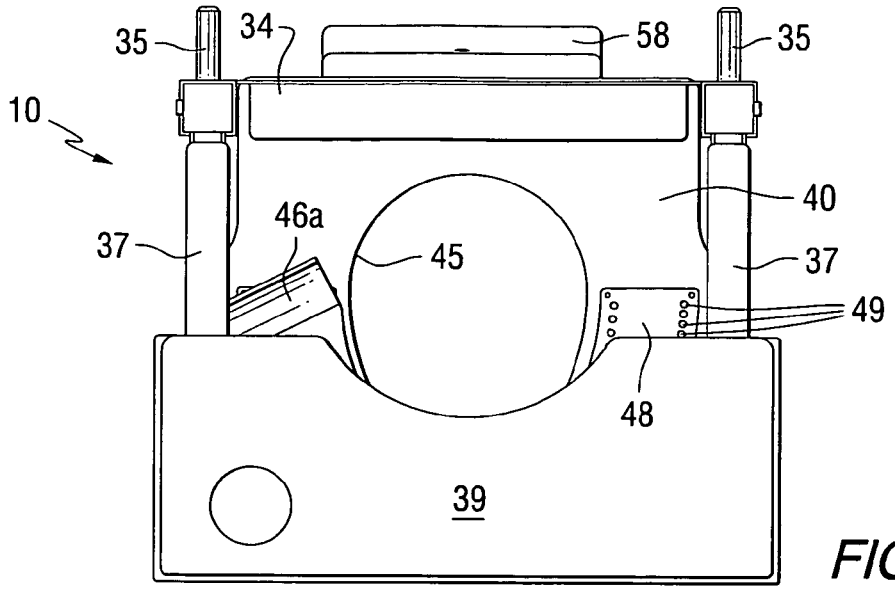
FIG. 3 is a top view of the support chair of FIG. 2.
Figure 5:
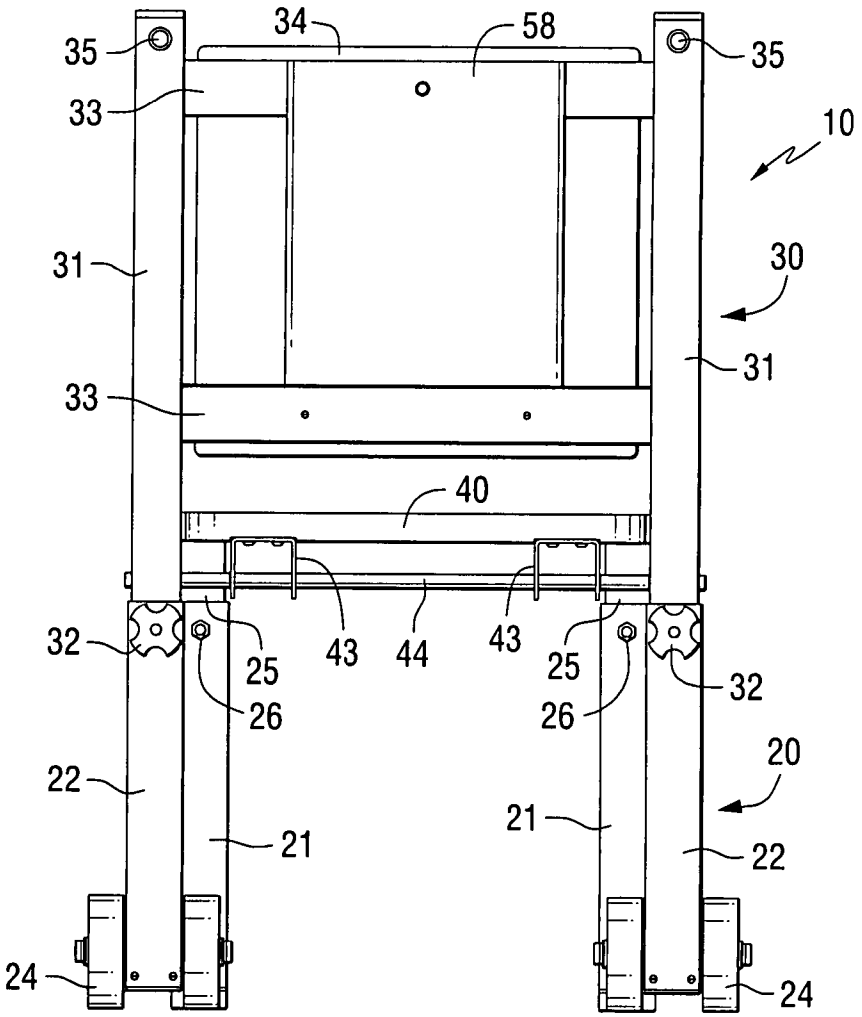
FIG. 5 is a back view of the support chair of FIG. 2.
Figure 4:
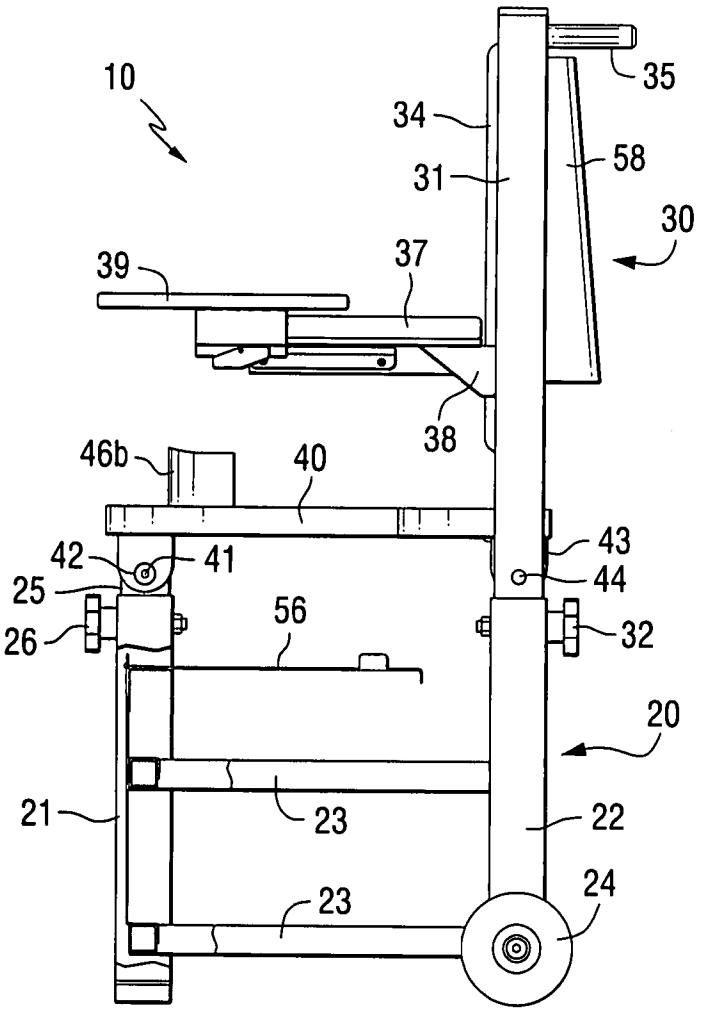
FIG. 4 is a side view of the support chair of FIG. 2.

In an embodiment of the present invention, a splash guard 52 may be removably mounted in or near the cutout 45 of the seat 40 in order to control urine flow, e.g., into the toilet 12 as shown in FIG. 1. The splash guard 52 may be made of flexible plastic, injection molded plastic or any other suitable material. A seatbelt 54 mounted on the extension arms 31 or any other suitable location on the support chair 10 may be used to secure a patient in the chair. A stowable bedpan support tray 56 may be mounted at any suitable location on the support chair 10. The bedpan support tray 56 may be moved to a position below the cutout 45 of the seat 40 in order to support a bedpan or other waste collection device. When not in use, the bedpan support tray 56 may be retracted or moved to a stowed location on the support chair 10, such as the stowed location shown in FIG. 1. As shown in FIGS. 3-5, a pouch 58 may be mounted on the back 30 of the support chair 10 and may be used to store items such as the removable armrests 37, toys, supplies, etc.

The components of the support chair 10 may be made from any suitable materials, such as metal, plastic, wood or the like. Stainless steel and aluminum are examples of suitable metals for the legs 21 and 22, horizontal supports 23 and 33, front extension arms 25, rear extension arms 31, and armrests 37. The seat 40 may be made of metal or a plastic such as PVC or injection molded plastic. The stirrups 46*a* and 46*b* may be made from plastic, metal, wood, or the like. ABS plastic is suitable. The stirrups may optionally be covered with any natural or synthetic material such as cloth, leather, vinyl or the like.

In addition to allowing a body cast patient to use a toilet, the support chair also serves as a means to support the patient in a comfortable, upright position. When equipped with the detachable and/or adjustable tray table 39, the patient may more easily perform activities such as eating, playing or working. The tray 39 may be pivotable to a stowed position, e.g., behind the back of the chair 10.

The seat 40 may be adjustable from a level position to an inclined or tilted position to assist the patient in sitting comfortably or in using the toilet. In the embodiment shown in FIGS. 1-5, the orientation of the seat is adjustable by providing telescoping or other height-adjustable legs which can independently be set at varying heights. The back 10 may also be adjustable from a vertical position to a slanted or tilted position, or movable up and down, to provide better support for the patient.

Various mechanisms can be used for raising, lowering and tilting the seat. For example, as shown in FIGS. 1-5, the front extension arms 25 and rear extension arms 31 are slidably received in the front legs 21 and back legs 22 of the base 20 in a telescoping fashion, allowing the upper portion to slide within the lower portion from a retracted position to an extended position. In one embodiment, e.g., as shown in FIG. 2, the telescoping legs may be spring loaded to assist in raising the legs, for example, when a patient is seated in the chair. The upper and lower portions may have a series of holes for engaging a retractable pin, screw or threaded handle. When the retractable pin, screw or threaded handle is engaged, the upper portion of the leg can be fixed at various sliding positions. Alternatively, each leg may have an upper portion that is clamped onto the lower portion using a vice-like clamping device, or any other suitable means for adjustment.

The seat 40 may be hingedly mounted to each extension arm 25 and 31, or mounted using another type of mechanical fastener, a ball and joint assembly, a frictional assembly, or the like. The seat 40 may be manually or automatically raised, lowered, or tilted in any direction that assists the spica cast or other patient in sitting upright or inclined, using the toilet, performing activities, etc. The back 34 may also be hingedly mounted to the base 20, back 30 and/or seat 40 of the support chair, or mounted using another type of mechanical fastener, a ball and joint assembly, a frictional assembly, or the like. The front legs 21 and rear legs 22 of the base 20 may be connected with various types of support braces to provide greater structural stability.

The embodiment shown in the figures includes adjustable leg support stirrups 46*a* and 46*b*. Alternatively, the stirrups may be integrally formed by contouring on the surface of the seat 40, in which case customized seat and stirrup contours may be provided for individual patients. On either side of the cut-out 45, the seat 40 may have natural depressions or curves which serve as stirrups designed to hold the legs of a spica or other cast. The seat 40 and/or stirrups 46*a* and 46*b* may have a foam or cushioned lining that molds to the shape of the spica cast, providing customized leg support regardless of the shape or size of the cast. The back 34 and armrests 37 may also have such a liner to cushion the spica cast as it rests against the chair, e.g., a vinyl covered foam backing.

Numerous variations of the details of the present invention may be made without departing from the invention. For example, the support chair may be equipped with other restraint or safety mechanisms in place of, or in addition to, the seat belt. The support chair may be foldable. The chair may be provided with a removable seat and/or backrest, or a removable seat or backrest cover, in order to change the design, pattern, color, etc. of the seat and/or backrest. The handles may be eliminated or removably mounted on the chair at any suitable location. Although the support chair shown in the figures is equipped two wheels at the bottom of the rear legs, additional wheel(s) may be added, for example, at the bottom of each front leg. The wheels may be lockable for safety purposes. The size of the wheels may also be selected as desired, e.g., larger or smaller wheels than shown in the figures may be used. A foot kick may optionally be mounted, e.g., near the bottom of each back leg in order to facilitate tilting of the chair onto its rear wheels for movement of the chair. In some cases, it may be desirable to motorize the support chair in order facilitate patient mobility.

Furthermore, electronic actuators or other types of actuators may be used, e.g., to adjust the seat height, leg height, backrest height, seat inclination, back inclination and the like. In one embodiment, markings may be provided on the support chair in order to indicate chair positions such as inclination or stirrup positions. For example, the back legs of the chair may be marked with degree marks at varying heights to indicate the angle of the seat and/or back of the chair at various telescoping locations of the rear legs. As another example, the stirrups and/or stirrup support plates may be marked with width and/or angle marks in order to facilitate the desired placement and orientation of the stirrups based upon a particular patient's needs.

In addition to the support chair shown in the figures, other types of chairs and/or seats may be retrofitted with support assemblies for body cast patients in accordance with embodiments of the present invention. Wheelchairs or the like may be retrofitted with the present stirrup seat, in which case the support seat may be mounted on a standard wheelchair frame. In addition, other types of seats and/or chairs may be retrofitted, such as car seats, toilets, household chairs and the like.

Whereas particular embodiments of this invention have been described above for purposes of illustration, it will be evident to those skilled in the art that numerous variations of the details of the present invention may be made without departing from the invention as defined in the appended claims.

The invention claimed is:

1. A support chair for a patient comprising:

a seat adjustable to different inclination angles measured from a horizontal direction;

a back adjustable to different reclining angles measured from a vertical direction, wherein the seat and back are adjustable to different positions in relation to each other; and at least one stirrup mounted directly on the seat structured and arranged to support a body cast of the patient, wherein the at least one stirrup is adjustably mountable at different angular orientations with respect to the seat measured in a plane of the seat.

2. The support chair of claim 1, wherein the at least one stirrup is adjustably mountable at different locations along a width of the seat.

3. The support chair of claim 1, wherein the at least one stirrup is adjustably mountable at different locations along a depth of the seat.

4. The support chair of claim 1, wherein the at least one stirrup is structured and arranged to support a leg portion of the body cast.

5. The support chair of claim 4, wherein the at least one stirrup has a generally U-shaped cross section.

6. The support chair of claim 1, wherein the at least one stirrup is replaceable with another stirrup of different size and/or shape.

7. The support chair of claim 1, wherein the at least one stirrup is covered with cushioned material.

8. The support chair of claim 1, wherein the at least one stirrup is integrally formed with the seat.

9. The support chair of claim 1, comprising two of the stirrups.

10. The support chair of claim 1, wherein the seat comprises a cut-out portion structured and arranged to allow the patient to use a waste collection device located below the seat.

11. The support chair of claim 10, wherein the waste collection device is a toilet.

12. The support chair of claim 10, wherein the waste collection device is a bedpan.

13. The support chair of claim 1, wherein the seat is adjustable to different heights.

14. The support chair of claim 1, wherein the inclination angles of the seat range from ±30° measured from the horizontal plane.

15. The support chair of claim 1, wherein the seat comprises at least one mounting plate to which the at least one stirrup is fastened.

16. The support chair of claim 15, wherein the at least one mounting plate comprises a plurality of holes for mounting the at least one stirrup at different locations on the seat.

17. The support chair of claim 1, further comprising:

a base;

at least one front support arm slidably mounted on the base supporting a front portion of the seat; and at least one rear support arm slidably mounted on the base supporting a rear portion of the seat.

18. The support chair of claim 17, wherein the seat is pivotally mounted on the at least one front support arm and on the at least one rear support arm.

19. The support chair of claim 17, wherein the at least one front support arm and the at least one rear support arm are movable to different heights to adjust the height and/or angle of the seat.

20. The support chair of claim 17, wherein the at least one rear support arm extends in a substantially vertical direction.

21. The support chair of claim 20, wherein the at least one rear support arm is adjustable to different reclining angles.

22. The support chair of claim 1, further comprising armrests mounted on the support chair.

23. The support chair of claim 1, further comprising an activity tray mounted on the support chair.

24. The support chair of claim 1, further comprising a splash guard mounted adjacent to a cut-out portion of the seat.

25. The support chair of claim 1, further comprising a seatbelt secured to the support chair structured and arranged to be fastened around the patient.

26. A support chair for a patient comprising:

a seat structured and arranged to support a body cast of the patient, wherein the seat is adjustable to different inclination angles measured from a horizontal direction;

a back adjustable to different reclining angles measured from a vertical direction, wherein the seat and back are adjustable to different positions in relation to each other;

an opening in the seat to allow the patient to use a waste collection device; and at least one stirrup mounted directly on the seat structured and arranged to support a body cast of the patient, wherein the at least one stirrup is adjustably mountable at different angular orientations with respect to the seat measured in a plane of the seat.

27. The support chair of claim 26, wherein the opening in the seat is generally U-shaped.

28. The support chair of claim 26, wherein the waste collection device is a toilet or bedpan.

29. The support chair of claim 26, wherein the opening in the seat is shaped to substantially correspond to an opening in a toilet seat.

30. The support chair of claim 26, wherein the seat is adjustable to different heights.

31. The support chair of claim 26, wherein the seat is adjustable to different inclination angles.

32. The support chair of Claim 26, further comprising:

a base;

at least one front support arm slidably mounted on the base supporting a front portion of the seat; and at least one rear support arm slidably mounted on the base supporting a rear portion of the seat.

33. A seat for a patient comprising:

at least one stirrup mounted directly on the seat structured and arranged to support a body cast of the patient, wherein the seat is adjustable to different inclination angles measured from a horizontal direction, and the at least one stirrup is adjustably mounted at different angular orientations with respect to the seat measured in a plane of the seat; and an opening in the seat to allow the patient to use a waste collection device.

34. The seat of claim 33, wherein the seat is mounted on a support chair comprising:

a base;

at least one front support arm slidably mounted on the base supporting a front portion of the seat; and at least one rear support arm slidably mounted on the base supporting a rear portion of the seat.

* * * * *